US010505330B2

(12) United States Patent
Lin

(10) Patent No.: US 10,505,330 B2
(45) Date of Patent: Dec. 10, 2019

(54) CRIMPING HAND TOOL

(71) Applicant: JETOOL CORP., New Taipei (TW)

(72) Inventor: Kai-Yen Lin, New Taipei (TW)

(73) Assignee: JETOOL CORP., New Taipei (TW)

( * ) Notice: Subject to any disclaimer, the term of this patent is extended or adjusted under 35 U.S.C. 154(b) by 313 days.

(21) Appl. No.: 15/484,106

(22) Filed: Apr. 10, 2017

(65) Prior Publication Data

US 2018/0062335 A1 Mar. 1, 2018

Related U.S. Application Data

(60) Provisional application No. 62/378,690, filed on Aug. 24, 2016.

(30) Foreign Application Priority Data

Feb. 21, 2017 (TW) ..... 106105746 A

(51) Int. Cl.
*H01R 43/01* (2006.01)
*H01R 24/64* (2011.01)

(52) U.S. Cl.
CPC ..... *H01R 43/015* (2013.01); *H01R 24/64* (2013.01)

(58) Field of Classification Search
CPC ..... H01R 24/64; H01R 43/015
See application file for complete search history.

(56) References Cited

U.S. PATENT DOCUMENTS 3,840,987 A * 10/1974 Netta ..... B21F 11/00 30/90.1
4,571,764 A * 2/1986 Chen ..... H02G 1/1212 7/107
4,754,636 A * 7/1988 Kautz ..... H01R 43/042 29/751
5,152,051 A * 10/1992 Folk ..... H01R 43/015 29/749
6,612,147 B2 * 9/2003 Beetz ..... B25B 7/12 7/128
2009/0217791 A1 * 9/2009 Battenfeld ..... B25B 7/04 81/421
2010/0005849 A1 * 1/2010 College ..... B23D 29/00 72/416
2011/0197648 A1 * 8/2011 Houser ..... H01R 43/0427 72/452.1
2012/0144893 A1 * 6/2012 Battenfeld ..... H01R 43/042 72/409.14
2012/0260714 A1 * 10/2012 Hutchfield ..... H01R 43/042 72/409.1

* cited by examiner

*Primary Examiner* — Carl J Arbes
(74) *Attorney, Agent, or Firm* — JCIPRNET

(57) ABSTRACT

A crimping hand tool for crimping a plurality of wires of a cable and a housing together to form a connector is provided. The crimping hand tool includes a first, a second, a third, a fourth, a fifth linking bodies, and a crimping assembly movably disposed in the second body. The first linking body has a first and a second ends opposite to each other, and the first end is pivoted to the first body. The second linking body has a third and a fourth ends opposite to each other, and the third end is slidably coupled to the second body. The second linking body has a fifth and a sixth ends opposite to each other, and the fifth end is pivoted to the second body. The second, the fourth, and the sixth ends are pivoted coaxially. The crimping assembly is pivoted to the third end.

15 Claims, 10 Drawing Sheets

CRIMPING HAND TOOL

CROSS-REFERENCE TO RELATED APPLICATION

This application claims the priority benefits of U.S. provisional application Ser. No. 62/378,690, filed on Aug. 24, 2016 and Taiwan application serial no. 106105746, filed on Feb. 21, 2017. The entirety of each of the above-mentioned patent applications is hereby incorporated by reference herein and made a part of this specification.

BACKGROUND OF THE INVENTION

Field of the Invention

The invention is related to a crimping hand tool.

Description of Related Art

Existing cable wires and cable connectors are commonly used for signal transmission such as network line and RJ45 connector for transmitting network signal as well as telephone line and RJ11 connector for transmitting telephone signal and so on. In order to connect wires to the needed equipment, the terminal end of the wires are generally connected to a corresponding connecting housing to form a cable connector. At this time, it is necessary to use a particular wire crimping tool to connect and fix the wire and the connecting housing together.

SUMMARY OF THE INVENTION

The invention provides a crimping hand tool for crimping a plurality of wires of a cable and a housing together to form a cable connector.

In the invention, the crimping hand tool is configured for crimping a plurality of wires of a cable and a housing together to form a connector. The crimping hand tool includes a first body, a second body, a first linking body, a second linking body, a second linking body and a crimping assembly. The first linking body has a first end and a second end opposite to each other, and the first end is pivoted to the first body. The second linking body has a third end and a fourth end opposite to each other, and the third end is slidably coupled to the second body. The second linking body has a fifth end and a sixth end opposite to each other, and the fifth end is pivoted to the second body. The second, the fourth and the sixth ends are pivoted together coaxially. The crimping assembly is movably disposed in the second body and pivoted to the third end. When the first body and the second body receive a force and are closed relative to each other, the first linking body, the second linking body and the second linking body are driven to push the crimping assembly so as to crimp the wire and housing together.

In one embodiment of the invention, the second body and the second linking body are pivoted in a first direction. The first body, the first linking body and the second linking body are pivoted in a second direction. The first direction is opposite to the second direction.

In one embodiment of the invention, the second body has a first crimping groove. The crimping assembly includes a first pivot shaft, a first crimping component and a second crimping component. The first crimping component and the second crimping component are pivoted to the third end via the first pivot shaft at the same time to be driven so that a portion of the first crimping component and the second crimping component enter or leave the first crimping groove simultaneously to crimp different portions of the housing.

The first crimping component and the second crimping component are disposed on two opposite sides of the first crimping groove.

In one embodiment of the invention, the crimping hand tool further includes a first blade assembled to the first crimping component. The first blade enters or leaves the first crimping groove along with the first crimping component to cut off a portion of the wires extending out of the housing.

In one embodiment of the invention, the second body further includes a second crimping groove suitable for another housing. The crimping assembly further includes a third crimping component pivoted to the first crimping component and the second crimping component so that the third crimping component moves along with the first crimping component and the second crimping component to enter or leave the second crimping groove simultaneously.

In one embodiment of the invention, the crimping hand tool further includes a second blade assembled to the third crimping component. The second blade enters or leaves the second crimping groove along with the third crimping component to cut off a portion of the wires of another cable extending out of another housing.

In one embodiment of the invention, the second body includes a clamp base, a pair of side plates and a clamp handle. The clamp base has the first crimping groove and the second crimping groove. The side plates are assembled on two opposite sides of the clamp base. The side plates and clamp base form a space to accommodate the crimping assembly, the second linking body, the second linking body and at least a portion of the first linking body. A fifth end of the second linking body is pivoted between the side plates. The clamp handle is assembled on the clamp base and disposed between the side plates.

In one embodiment of the invention, the second body includes expanding holes respectively located on the side plates. The two opposite ends of the first pivot shaft are rotatably and slidably coupled to the pair of expanding holes.

In one embodiment of the invention, a seventh end of the second linking body further has a ratch structure. The crimping hand tool further includes a second pivot shaft, a retainer block, a first elastic component and a knob. The second pivot shaft is pivoted between the side plates. The retainer block covers the second pivot shaft to rotate along with the second pivot shaft. The retainer block is disposed in a moving path of the seventh end so that the retainer block temporarily interferes on the ratch structure when the first body and the second body are opened and closed relative to each other. The first elastic component is connected between the second body and the retainer block. The first elastic component always drives the retainer block to rotate in a third direction. When the first body and the second body are closed, the ratch structure always drives the retainer block to rotate in a fourth direction. The third direction is opposite to the fourth direction. The knob is connected to the second pivot shaft and disposed outside the second body. The knob is adaptable to receive force to drive the second pivot shaft so as for the retainer block to move away from the ratch structure.

In one embodiment of the invention, the second body includes a plurality of guiding grooves disposed on the clamp base and respectively correspond to the first crimping component, the second crimping component and the third crimping component. An extending direction of the guiding grooves is consistent with a crimping direction of the crimping assembly to be respectively orthogonal to a penetrating direction of the first crimping groove and a penetrating direction of the second crimping groove.

In one embodiment of the invention, the third crimping component includes a first portion and a second portion. The first portion and the second crimping component are an integrated structure. The second portion is pivoted between the first portion and the first crimping component.

In one embodiment of the invention, the first linking body and the second linking body respectively consist of a single structure body or a coupled structure body.

In one embodiment of the invention, the crimping hand tool further includes a third blade and a block. The third blade is disposed on one of the first body and the second body. The block is disposed on the other one of the first body and the second body. When the first body and the second body are closed relative to each other, the block and the third blade form a peeling space.

In one embodiment of the invention, the crimping hand tool further includes a second elastic component connected between the block and the first body, or connected between the block and the second body. The second elastic component always drives the block to move toward the second body or first body to press against the third blade and maintain the peeling space.

In one embodiment of the invention, the crimping hand tool further includes a third elastic component connected between the first body and the second body. The third elastic component always drives the first body to be opened relative to the second body.

Based on the above, for the crimping hand tool in the invention, with the first body, the second body, the first linking body, the second linking body and the second linking body that constitute a linkage relationship, when the first body and the second body are held by the user and receive force therefrom, the first linking body, the second linking body and the second linking body can be driven to pivot coaxially so as to drive the crimping assembly that is pivoted to the second linking body to slide in the second body. As such, the plurality of wires of the cable and the housing can be crimped together in a one-time manner to form the cable connector.

In order to make the aforementioned features and advantages of the invention more comprehensible, embodiments accompanying figures are described in detail below.

DESCRIPTION OF EMBODIMENTS

Figure 1:
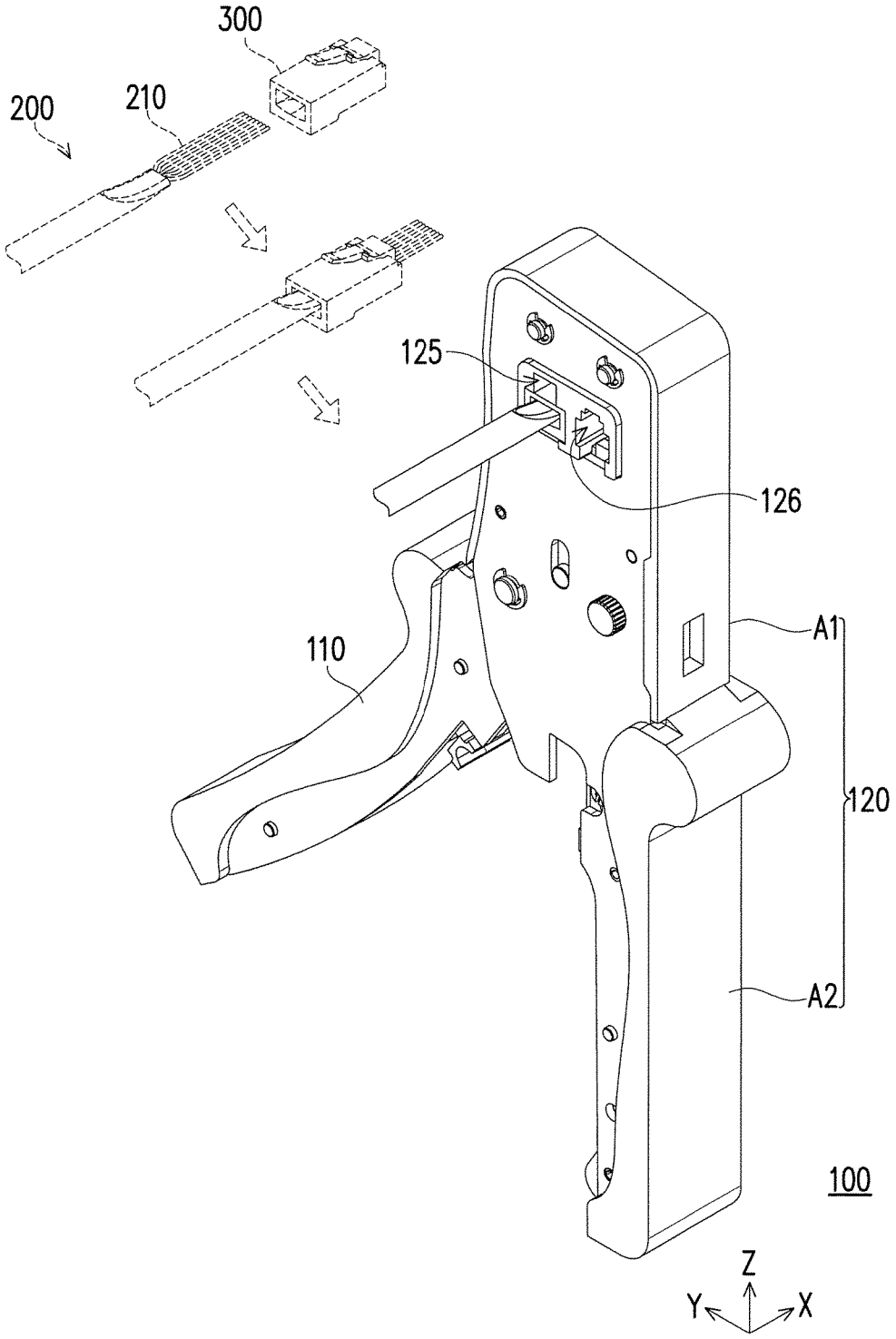
FIG. 1 is a schematic view of a crimping hand tool according to one embodiment of the invention.
Figure 2:
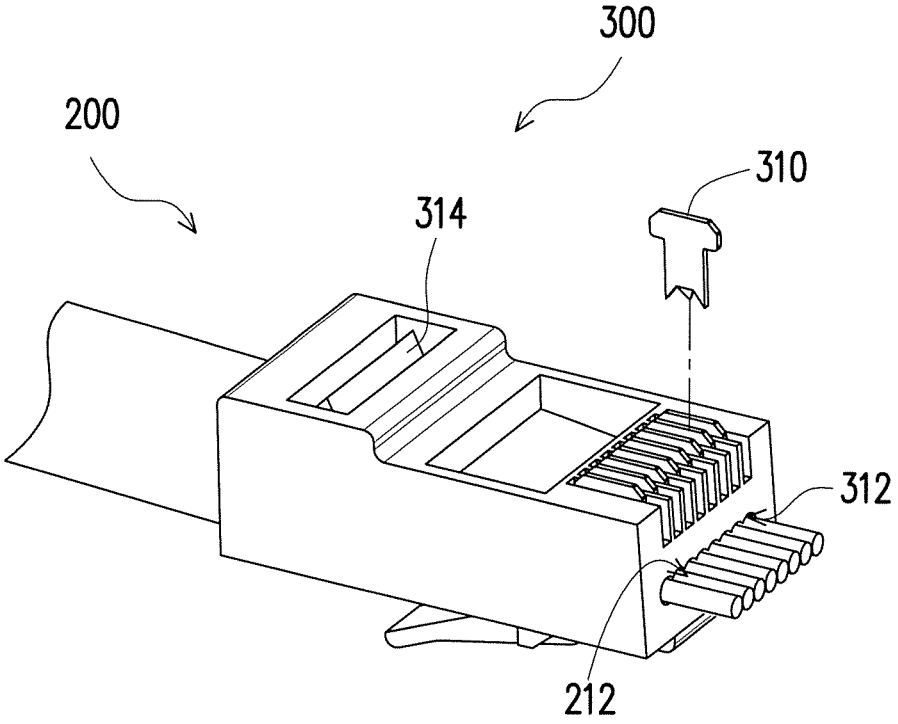
FIG. 2 is a schematic view showing crimping of a connector in FIG. 1.

FIG. 1 is a schematic view of a crimping hand tool according to one embodiment of the invention. FIG. 2 is a schematic view showing crimping of a connector in FIG. 1. Meanwhile, a Cartesian coordinate X-Y-Z is provided for easy reference of components. Referring to FIGS. 1 and 2, in the embodiment, a crimping hand tool 100 is used for crimping a plurality of wires 210 of a cable 200 and a housing 300 together to form a cable connector. FIG. 2 shows a schematic view of crimping the cable 200 and the housing 300 as well as a conductive sheet 310 thereof. FIG. 1 and FIG. 2 clearly show that the user passes the plurality of wires 210 of the cable 200 through a through hole 312 of the housing 300 first, and then put the plurality of wires 210 into a first crimping groove 125 of the crimping hand tool 100 so as to operate the crimping hand tool 100 to crimp the housing 300 and the cable 200 together. As such, the conductive sheet 310 breaks through an insulating layer of the wires 210 to be electrically connected to the conductive line therein so that the conductive sheet 310 becomes a terminal of the cable connector.

Figure 3A:
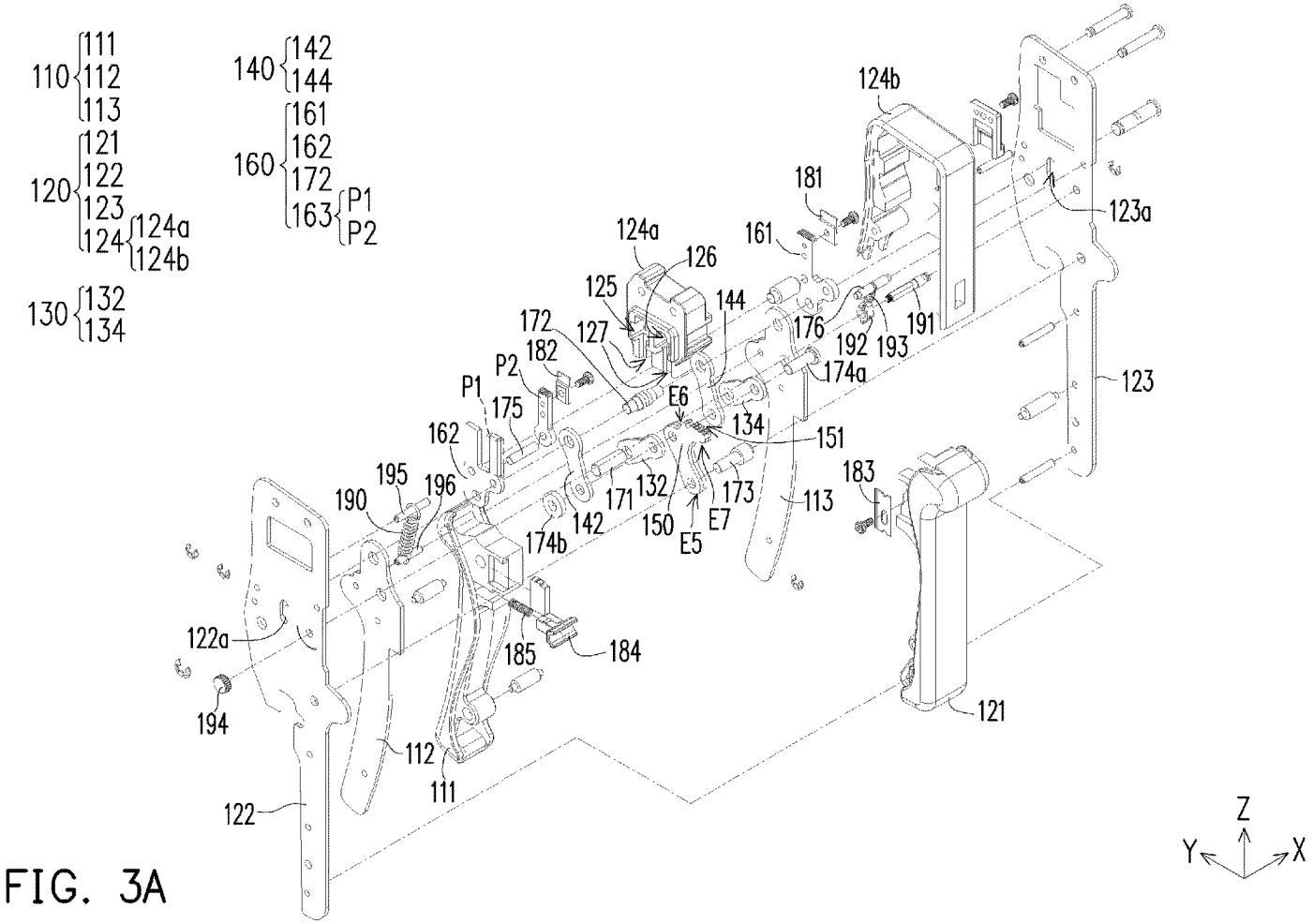
FIG. 3A is an explosive view of the crimping hand tool in FIG. 1.

FIG. 3A is an explosive view of the crimping hand tool in FIG. 1. Referring to FIG. 1 and FIG. 3A, in the embodiment, the crimping hand tool 100 includes a first body 110, a second body 120, a first linking body 130, a second linking body 140, a third linking body 150 and a crimping assembly 160. Here, the second body 120 is a main body of the crimping hand tool 100, which substantially includes a portion A1 that accommodates other components and a portion A2 to be held by the user. The first body 110 is mainly to be held by the user and drives the other components in the second body 120.

As shown in FIG. 3A, the first body 110 includes a clamp handle 111 and side plates 112 and 113 assembled on two opposite sides thereof along an X-axis. The second body 120 includes a clamp handle 121 and side plates 122 and 123 assembled on two opposite sides of the clamp handle 121 along the X-axis as well as a clamp base 124 disposed between the side plates 122 and 123. The clamp base 124 includes an inner base 124*a* and an outer frame 124*b*. The inner base 124*a* is embedded in the outer frame 124*b*, and then assembled on the outer frame 124*b* via a portion of each of the side plates 122 and 123 to form the portion A1. Moreover, another portion of each of the side plates 122 and 123 is combined with the clamp handle 121 to form the portion A2.

Figure 3B:
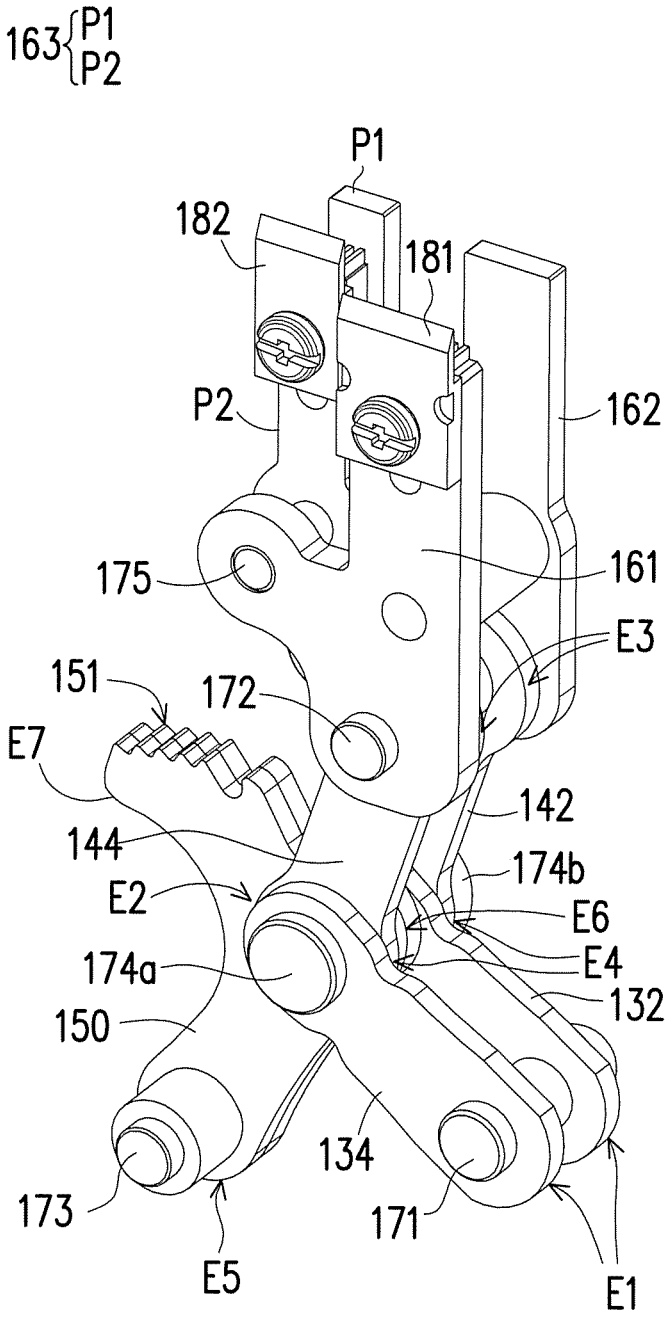
FIG. 3B is a view illustrating assembly of a portion of components in FIG. 3A.

FIG. 3B is a schematic view showing assembly of a portion of components in FIG. 3A. Referring to FIG. 3A and FIG. 3B, in the embodiment, the first linking body 130 includes components 132 and 134 coupled with each other. Furthermore, the first linking body 130 has a first end E1 and a second end E2 opposite to each other, wherein the first end E1 is pivoted to the first body 110. In other words, the components 132 and 134 are pivoted between the side plates 112 and 113 of the first body 110 via a pivoting component 171 along the X-axis. Similarly, the second linking body 140 includes components 142 and 144 coupled with each other, and the second linking body 140 has a third end E3 and a fourth end E4 opposite to each other. The third end E3 is slidably coupled to the second body 120. The components 142 and 144 are slidably pivoted to guiding portions 122*a* and 123*a* on the side plates 122 and 123 of the second body 120 via the first pivot shaft 172, which are, for example, expanding holes on the side plates 122 and 123 respectively so that the third end E3 can pivot about the X-axis and slide relative to the second body 120 along the Z-axis. Detailed descriptions are incorporated in the paragraphs below.

The third linking body 150 has a fifth end E5 and a six end E6 opposite to each other, wherein the fifth end E5 is pivoted to the second body 120. In other words, the fifth end E5 is pivoted between the side plates 122 and 123 of the second body 120 via a pivoting component 173. It should be pointed out that the second end E2, the fourth end E4 and the sixth end E6 are pivoted together coaxially (along the X-axis) via pivoting components 174*a* and 174*b* so that the first through the fifth linking bodies can form a linkage relationship therebetween. A crimping assembly 160 is movably disposed in the second body 120. Furthermore, the crimping assembly 160 includes a first crimping component 161, a second crimping component 162 and the first pivot shaft 172, wherein the first crimping component 161 and the second crimping component 162 are pivoted to the third end E3 of the second linking body 140 via the first pivot shaft 172 at the same time. Referring to FIG. 3B, the components 132, 134, 142, 144, and the third linking body 150 are formed a toggle joint structure, wherein the components 132 and 134 are referred as a toggle joint couple, the components 142 and 144 are referred as another toggle joint couple.

In addition, the clamp base 124 of the second body 120 has a first crimping groove 125 and the second crimping groove 126 which respectively pass through the clamp base 124 in the X-axis and used for accommodating different types of housing 300. For the second body 120, a space can be formed when the side plates 122 and 123 are assembled on the clamp base 124 to accommodate the crimping assembly 160, the second linking body 140, the third linking body 150 and at least a portion of the first linking body 130. On the other hand, the clamp base 124 further includes a guiding portion 127 which is a structure such as a guiding groove of the inner base 124*a* or a guiding plane disposed in the inner base 124*a*. The guiding portion 127 corresponds to the first crimping component 161 and the second crimping component 162 so that an extending direction of the guiding portion 127 is consistent with a crimping direction (which is horizontal to the Z-axis) of the crimping assembly 160, that is, to be orthogonal to a penetrating direction of the first crimping groove 125 or the second crimping groove 126, so as to provide a guiding effect for the first crimping component 161 and the second crimping component 162 to slide only along the Z-axis.

Here, the second crimping groove 126 is used for accommodating another type of housing, and the crimping assembly 160 further includes a third crimping component 163 that is pivoted to the first crimping component 161 and the second crimping component 162 via the pivoting component 175 so that the third crimping component 163 moves along with the first crimping component 161 and the second crimping component 162 simultaneously to enter or leave the second crimping groove 126. Here, the third crimping component 163 also enters or leaves the second crimping groove 126 along the X-axis via the guiding portion 127. To be specific, the third crimping component 163 includes a first portion P1 and a second portion P2. The first portion P1 and the second crimping component 162 are an integrated structure. The second portion P2 is pivoted between the first portion P1 and the first crimping component 161 via the pivoting component 175.

Based on the above, with the linkage relationship between the first to the fifth linking bodies, when the user holds the first body 110 and the second body 120 and applies force thereto to open/close them, a linkage movement is generated between the first linking body 130, the second linking body 140 and the third linking body 150 so that the crimping assembly 160 is driven to slide in the second body 120 in a positive Z-axis direction. As such, a crimping action is performed on the cable 200 and the housing 300 in the first crimping groove 125 or the second crimping groove 126.

Figure 3C:
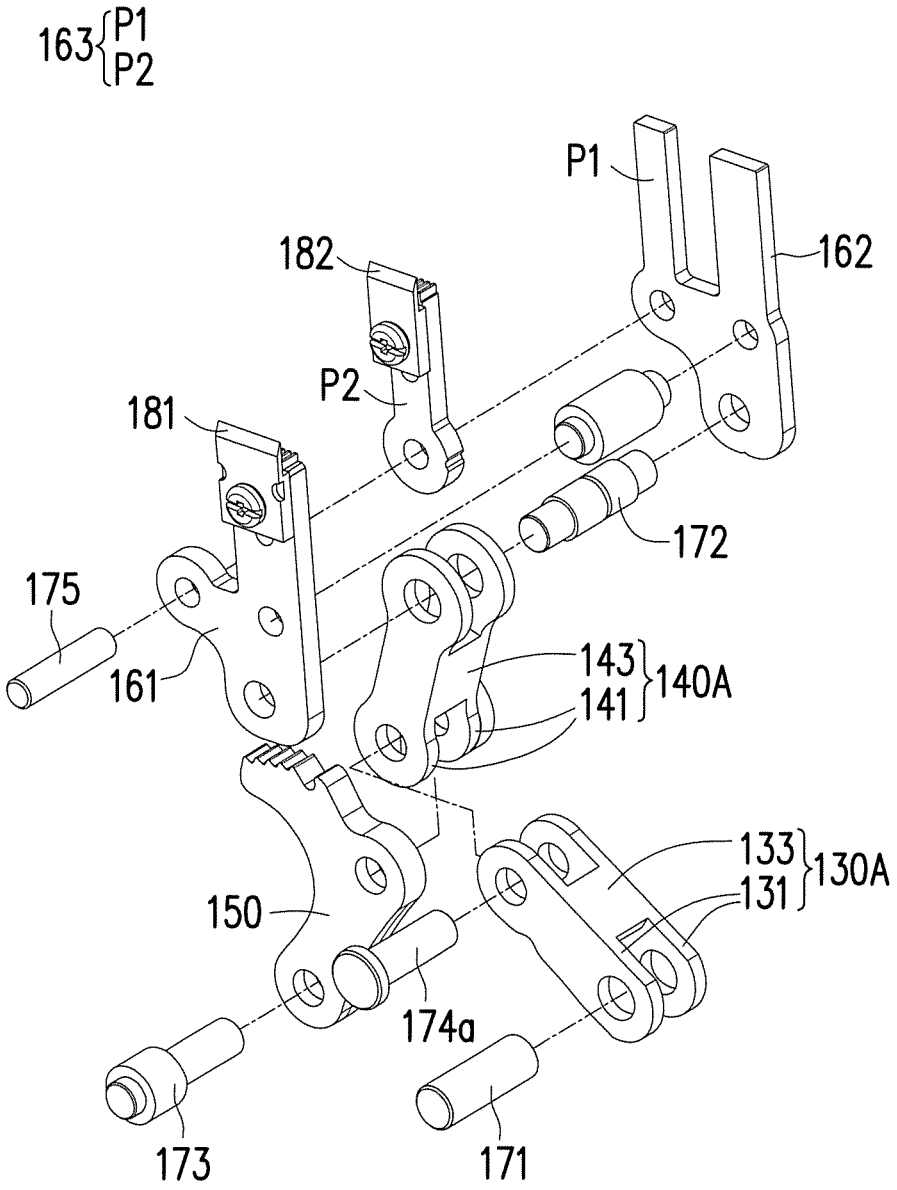
FIG. 3C is a schematic view of a portion of components of a crimping hand tool according to another embodiment of the invention.

Also, it should be indicated that FIG. 3C is a schematic view of a portion of components of a crimping hand tool according to another embodiment of the invention. Comparing FIGS. 3B and 3C, different from the aforementioned embodiment, the first linking body 130A and the second linking body 140A in the embodiment are respectively a single structure body that is different from the coupled structure body in the previous embodiment. Here, the first linking body 130A includes side portions 131 and a linking portion 133 connected therebetween. The second linking body 140A includes side portions 141 and a linking portion 143 connected therebetween. Meanwhile, the structure in the embodiment can also achieve the same moving and driving effect as described in the previous embodiment.

Figure 4A:
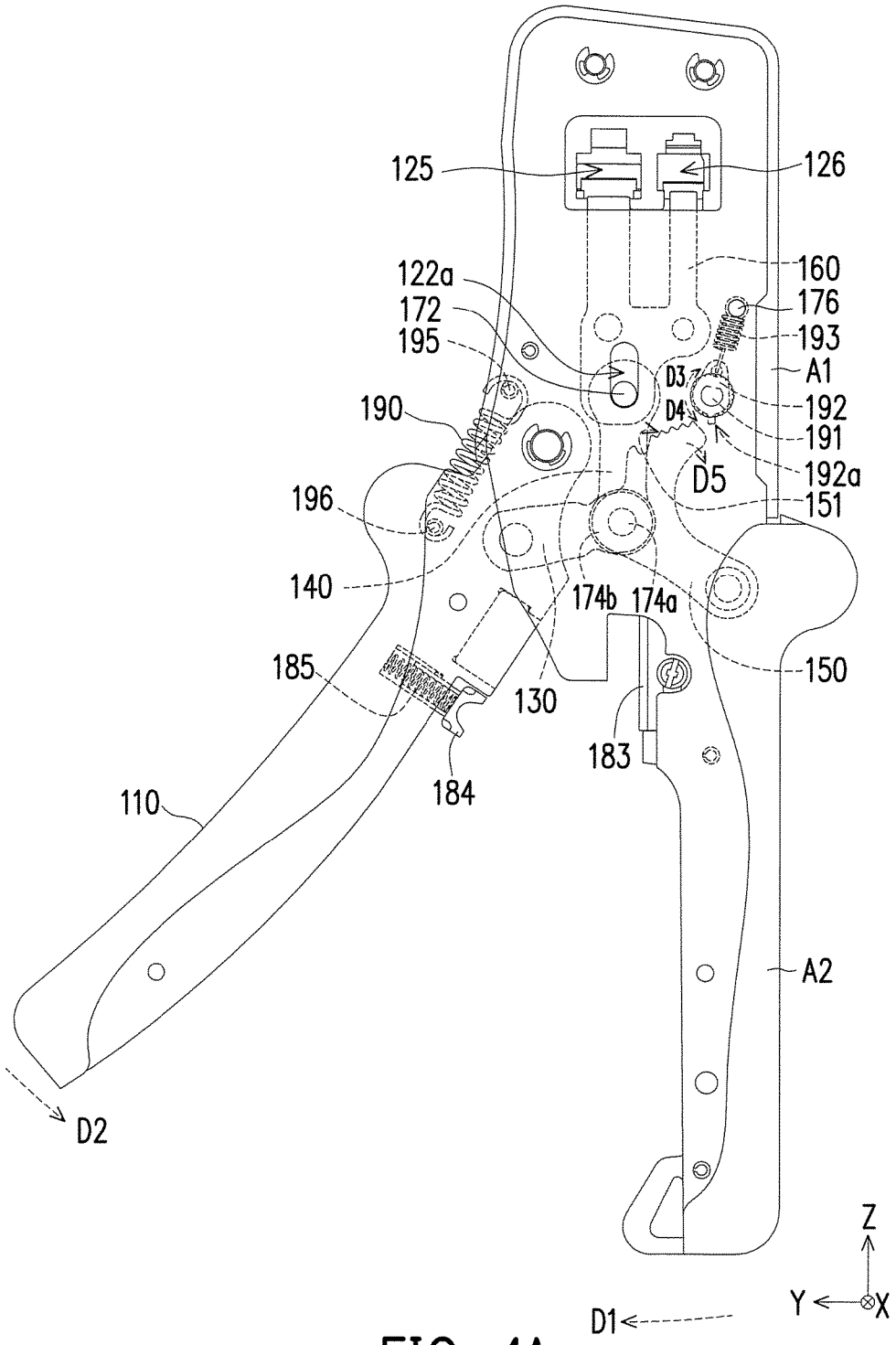
FIG. 4A and FIG. 4B are schematic views illustrating crimping actuation of a crimping hand tool.
Figure 4B:
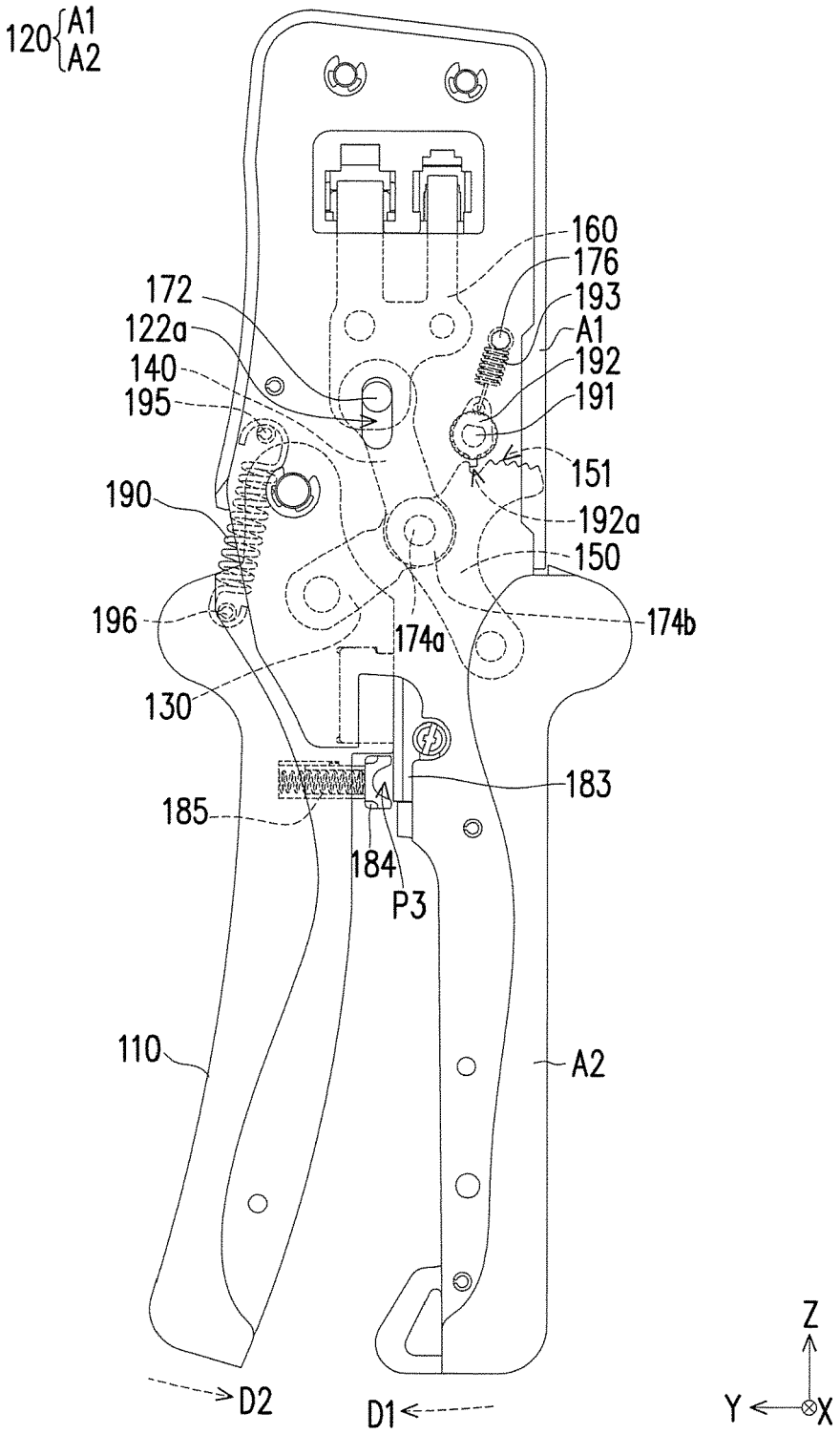
Figure 4C:
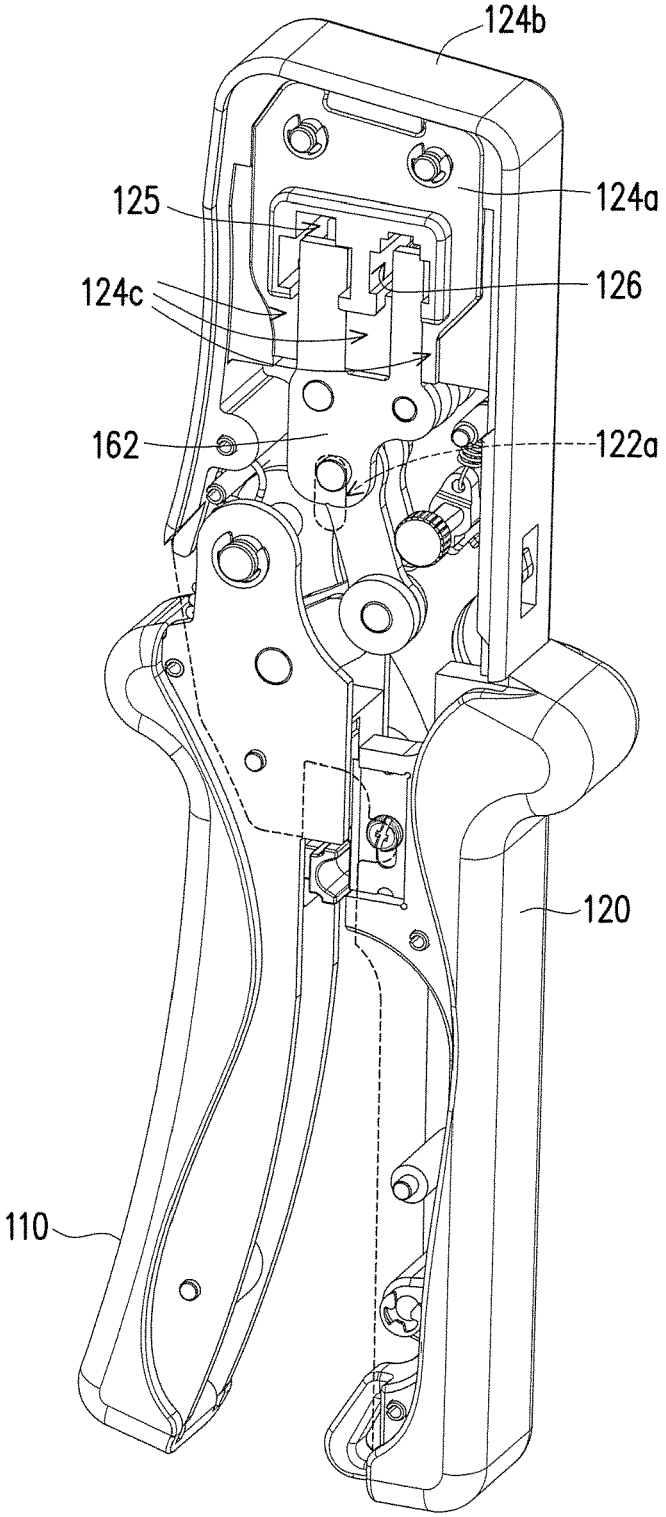
FIG. 4C and FIG. 4D are schematic views showing inside of a crimping hand tool from different viewing angles.
Figure 4D:
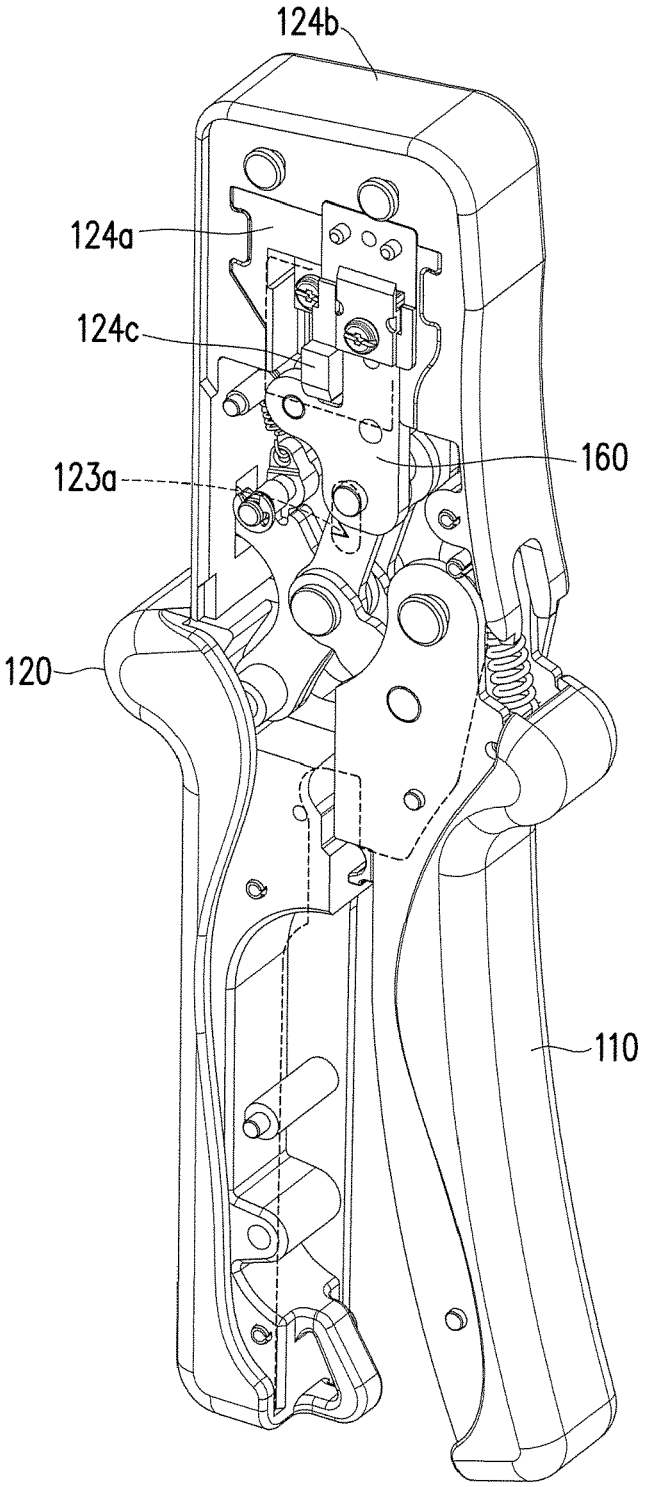

FIG. 4A and FIG. 4B are schematic views illustrating crimping actuation of a crimping hand tool. FIG. 4C and FIG. 4D are schematic views showing inside of a crimping hand tool from different viewing angles. Referring to FIG. 4A to FIG. 4D at the same time, as described above, when the user holds and applies force to the first body 110 and the second body 120, the first body 110 is pivoted in the second direction D2 and the second body 120 is pivoted in the first direction D1. In the meantime, with the linkage relationship between the above-mentioned linking bodies, the third linking body 150 is pivoted in the first direction D1; the first linking body 130 and the second linking body 140 are pivoted in the second direction D2. The first direction D1 is opposite to the second direction D2.

As mentioned above, since the second body 120 has the guiding portions 122*a*, 123*a*, 127 and so on, the pivoting actions of the first body 110 to the third linking body 150 can be smoothly converted into a sliding action of the crimping assembly 160 along the crimping direction (along Z-axis). As shown in FIGS. 4C and 4D, one of the side plates 122 and 123 of the second body 120 is omitted (see the dashed lines in the drawings). As such, it can be clearly seen that the inner base 124*a* has a protrusion structure 124*c* that forms the guiding groove to provide sufficient bearing and guiding effect for the crimping assembly 160. Therefore, the protrusion structure 124*c* can also be regarded as the guiding portion of the second body 120 for guiding the crimping assembly 160.

Figure 5A:
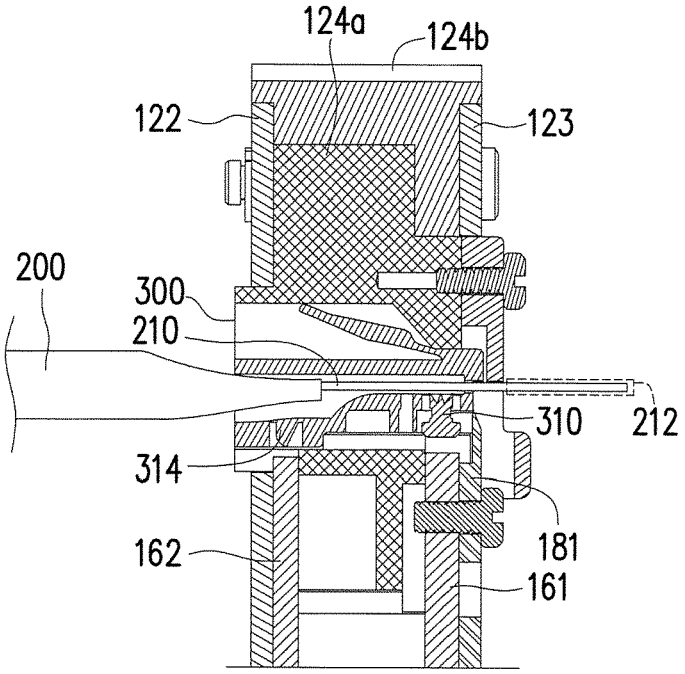
FIG. 5A and FIG. 5B are sectional views respectively showing actuation of crimping a connector.
Figure 5B:
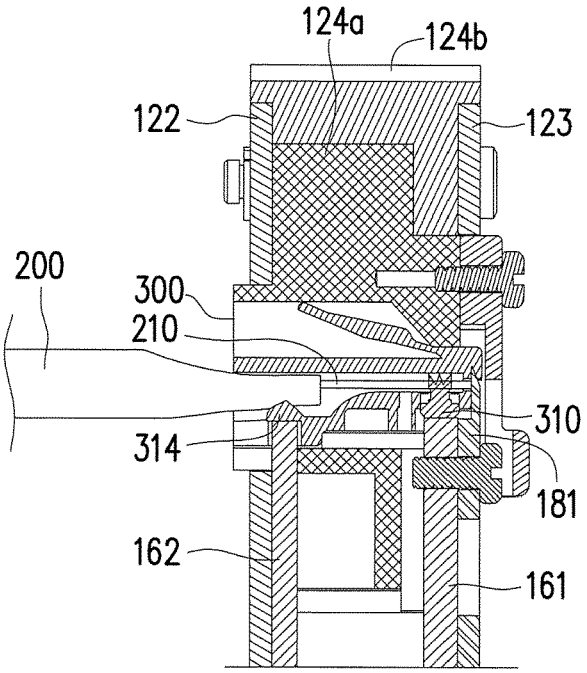

Further referring to FIG. 3A, FIG. 4A and FIG. 4B, in the embodiment, the crimping hand tool 100 further includes a first blade 181 and a second blade 182, wherein the first blade 181 is assembled to the first crimping component 110. The first blade 181 enters or leaves the first crimping groove 125 along with the first crimping component 161. The second blade 182 is assembled to the third crimping component 163. The second blade 182 enters or leaves the second crimping groove 126 along with the third crimping component 163. FIG. 5A and FIG. 5B are sectional views respectively showing actuation of crimping a connector. Referring to FIG. 2 first, the user passes the plurality of wires 210 of the cable 200 through the housing 300 first, and a portion 212 of the wires 210 is passed through to extend out of the housing 300. Thereafter, the housing 300 and cable 200 as illustrated in FIG. 2 are put into the first crimping groove 125 of the crimping hand tool 100. As shown in FIG. 1, a sectional view of the crimping hand tool 100 in the first crimping groove 125 is as illustrated in FIG. 5A; it is also shown that the portion 212 also passes through the second body 120 along the X-axis. Subsequently, after the crimping process as shown in FIG. 4A to FIG. 4B, as illustrated in FIG. 5B, the first crimping component 161 forces the conductive sheet 310 to penetrate the insulating layer of the cable to be electrically connected to the wires 210. The second crimping component 162 pushes a crimping block 314 of the housing 300 toward and to be crimped to the cable 200. Meanwhile, the first blade 181 simultaneously cuts off the portion 212 of the wires 210 extending out of the housing 300.

Similarly, the user can use another type of housing and cable to be moved into the second crimping groove 126 and perform the above-mentioned crimping action via the third crimping component 163 (including a first portion P1 and a second portion P2) and use the second blade 182 to cut off a portion of the wires of another type of cable extending out of the housing.

Further referring to FIGS. 3A, 4A and 4B, in the embodiment, the crimping hand tool 100 further includes an elastic component 190 connected between the first body 110 and the second body 120. Here, one end of the elastic component 190 is connected to a spacer 195 on the second body 120, and the other end of the elastic component 190 is connected to a spacer 196 on the first body 110. The elastic component 190 constantly drives the first body 110 to pivot to be opened relative to the second body 120. That is to say, when the user performs a crimping action, as shown in FIG. 4B, the elastic component 190 is deformed by the user. As such, when the user finishes the crimping action and releases the force, the first body 110 and the second body 120 can restore to the status as shown in FIG. 4A via the elastic component 190.

Further referring to FIGS. 3A and 3B, in the embodiment, a seventh end E7 of the third linking body 150 further includes a ratch structure 151. The crimping hand tool 100 further includes a second pivot shaft 191, a retainer block 192, an elastic component 193 and a knob 194. The second pivot shaft 191 is pivoted between the side plates 122 and 123. The retainer block 192 covers the second pivot shaft 191 to rotate along with the second pivot shaft 191. The elastic component 193 is connected between the spacer 176 of the second body 120 and the retainer block 192. Further referring to FIGS. 4A and 4B, a protrusion portion 192*a* of the retainer block 192 is actually disposed on a moving path of the ratch structure 151 of the seventh end E7. As such, the protrusion portion 192*a* and the ratch structure 151 can temporarily interfere with each other (temporarily locked with each other) in the process that the first body 110 and the second body 120 are pivoted to be opened and closed due to application of force.

FIGS. 4A to 4B show that the ratch structure 151 rotates in a fifth direction D5 so as drive the retainer block 192 to rotate in a fourth direction D4. The elastic component 193 constantly drives the retainer block 192 to rotate in a third direction D3, wherein the third direction D3 is opposite to the fourth direction D4. Here, the description of "temporarily interfere" (temporarily lock) refers to that the user can apply additional force to release the locking relationship or re-apply the force to lock them together. As such, when an abnormal crimping circumstance occurs between the first body 110 and the second body 120 in the crimping process and causes them to be locked (or jammed), the user can rotate the retainer block 192 to be detached from the ratch structure 151 to release the locking (jammed) status.

In addition, the knob 194 is connected with the second pivot shaft 191 and disposed outside of the second body 120. The knob 194 is adaptable to receive force to drive the second pivot shaft 191 so that the retainer block 192 moves away from the ratch structure 151 to release the temporary locking relationship. Here, the knob 194 is configured for the user to apply force and rotate so as to drive the second pivot shaft 191 and the retainer block 192. In another embodiment that is not shown, the user can use a suitable tool (e.g. a driver) to directly press against the second pivot shaft 191 (e.g. corresponding to a trench of the driver) so as to drive the retainer block 192 without the knob.

Further referring to FIGS. 3A, 4A and 4B, in the embodiment, the crimping hand tool 100 further includes a third blade 183, a block 184 and an elastic component 185. The third blade 183 is disposed on one of the first body 110 and the second body 120. The block 184 is disposed on the other one of the first body 110 and the second body 120. Here, the embodiment is exemplified with the third blade 183 disposed on the second body 120 and the block 184 disposed on the first body 110, which should not be construed as a limitation to the invention. That is, the third blade 183 and the block 184 that can be opened and closed along with the motion of the first body 110 and second body 120 are all applicable to the embodiment. The elastic component 185 is connected between the block 184 and the first body 110. When the first body 110 and the second body 120 are pivoted to be closed relative to each other, as shown in FIG. 4B, the block 184 and the third blade 183 are contacted with each other and form a peeling space P3, and the elastic component 185 constantly drives the block 184 to move toward the second body 120 to press against the third blade 183 and maintain the peeling space P3. The peeling space P3 makes it easy for the user to peel off the insulating layer of the cable 200 or wires 210 so as to increase the applicability and convenience of the crimping hand tool 100.

Based on the above, for the crimping hand tool in the embodiment of the invention, with the linkage relationship constituted by the first body, the second body, the first linking body, the second linking body and the second linking body, when the first body and the second body are held by the user and receive force therefrom, the first linking body, the second linking body and the second linking body can be driven to pivot coaxially so as to drive the crimping assembly pivoted to the second linking body to slide in the second body. As such, the plurality of wires of the cable and the housing can be crimped together at one time to form the cable connector.

A partial structure of the second body forms a guiding portion extending along the Z-axis, and includes the expanding holes disposed on the side plates as well as the guiding plane or guiding groove disposed on the clamp base. As such, the pivoting action of the linking body can be smoothly converted into the crimping action sliding along the Z-axis so that the crimping assembly can enter or leave the crimping groove of the second body in the crimping direction.

The crimping assembly is provided with the blade so as to cut off the portion of the wires extending out of the housing when the crimping component enters the crimping groove.

The second body has different types of crimping groove to correspond to various types of housing so the applicability of the crimping hand tool can be increased effectively.

The crimping hand tool further includes the retainer block and the linking body having the ratch structure so that the retainer block and the ratch structure can temporarily interfere with each other and be locked when the linking body moves. Since the retainer block is pivoted to the second pivot shaft, the user can also apply force to the second pivot shaft so as to fix problems when the crimping action cannot be performed smoothly.

Although the invention has been disclosed by the above embodiments, the embodiments are not intended to limit the invention. It will be apparent to those skilled in the art that various modifications and variations can be made to the structure of the invention without departing from the scope or spirit of the invention. Therefore, the protecting range of the invention falls in the appended claims.

What is claimed is:

1. A crimping hand tool, for crimping a plurality of wires of a cable and a housing together to form a connector, comprising:

a first body;

a second body, pivoted to the first body;

a first linking body, comprising a first end and a second end opposite to each other, the first end pivoted to the first body;

a second linking body, comprising a third end and a fourth end opposite to each other, the third end slidably coupled to a guiding portion of the second body;

a third linking body, comprising a fifth end and a sixth end opposite to each other, the fifth end pivoted to the second body, and the second end, the fourth end and the sixth end pivoted together coaxially; and a crimping assembly, movably disposed in the second body and pivoted to the third end, wherein when the first body and the second body are forced and pivoted relative to each other, the first linking body, the second linking body and the third linking body are driven to push the crimping assembly so as to crimp the wires and the housing together, wherein a portion of the crimping assembly is slidably coupled to another guiding portion of the second body.

2. The crimping hand tool according to claim 1, wherein the second body and the third linking body are pivoted in a first direction, the first body, the first linking body and the second linking body are pivoted in a second direction, the first direction is opposite to the second direction.

3. The crimping hand tool according to claim 1, wherein the second body comprises a first crimping groove, the crimping assembly comprises:

a first pivot shaft; and a first crimping component and a second crimping component, pivoted to the third end via the first pivot shaft at the same time so as to be driven to move a portion of the first crimping component and a portion of the second crimping component to enter or leave the first crimping groove simultaneously and to crimp different portions of the housing, the first crimping component and the second crimping component disposed on two opposite sides of the first crimping groove.

4. The crimping hand tool according to claim 3, further comprising:

a first blade, assemble to the first crimping component, the first blade entering or leaving the first crimping groove along with the first crimping component to cut off a portion of the wires extending out of the housing.

5. The crimping hand tool according to claim 3, wherein the second body further comprises a second crimping groove, the crimping assembly further comprises:

a third crimping component, pivoted to the first crimping component and the second crimping component, and the first linking body moving along with the first body the second body to enter or leave the second crimping groove simultaneously.

6. The crimping hand tool according to claim 5, further comprising:

a second blade, assembled to the third crimping component, the second blade entering or leaving the second crimping groove along with the third crimping component to cut off a portion of the wires of another cable extending out of another housing.

7. The crimping hand tool according to claim 5, wherein the second body comprises:

a clamp base, comprising the first crimping groove and the second crimping groove;

a pair of side plates, assembled on two opposite sides of the clamp base, wherein the pair of side plates and the clamp base form a space to accommodate the crimping assembly, the second linking body, the third linking body and at least a portion of the first linking body, the fifth end of the third linking body are pivoted between the pair of side plates; and a crimping handle, assembled on the clamp base and disposed between the side plates.

8. The crimping hand tool according to claim 7, wherein the second body comprises expanding holes disposed on the pair of side plates respectively to form the guiding portion, two opposite ends of the first pivot shaft are rotatably and slidably coupled to the pair of expanding holes.

9. The crimping hand tool according to claim 7, wherein a seventh end of the third linking body further comprises a ratch structure, the crimping hand tool further comprises:

a second pivot shaft, pivoted between the pair of side plates;

a retainer block, covering the second pivot shaft to rotate along with the second pivot shaft, the retainer block disposed on a moving path of the seventh end so that the retainer block temporarily interferes with the ratch structure when the first body and the second body are pivoted relative to each other;

a first elastic component, connected between the second body and the retainer block, wherein the first elastic component constantly drives the retainer block to rotate in a third direction, when the first body and the second body are pivoted relatively to be closed with each other, the ratch structure always drives the retainer block to rotate in a fourth direction, the third direction is opposite to the fourth direction; and a knob, connected to the second pivot shaft and disposed outside the second body, wherein the knob is forced to drive the second pivot shaft to move the retainer block away from the ratch structure.

10. The crimping hand tool according to claim 7, wherein the second body comprises a plurality of guiding grooves disposed on the clamp base to the another guiding portion and respectively correspond to the first crimping component, the second crimping component and the third crimping component, extending directions of the guiding grooves are consistent with a crimping direction of the crimping assembly and respectively orthogonal to a penetrating direction of the first crimping groove and a penetrating direction of the second crimping groove.

11. The crimping hand tool according to claim 5, wherein the third crimping component comprises a first portion and a second portion, the first portion and the second crimping component are formed together to be an integrated structure, and the second portion is pivoted between the first portion and the first crimping component.

12. The crimping hand tool according to claim 1, wherein the first linking body and the second linking body respectively consist of a single structured body, or the first linking body and the second linking body respectively consist of couple structured bodies.

13. The crimping hand tool according to claim 1, further comprising:

a third blade, disposed on one of the first body and the second body; and a block, disposed on the other one of the first body and the second body, wherein when the first body and the second body are pivoted to be closed relative to each other, the block and the third blade form a peeling space.

14. The crimping hand tool according to claim 13, further comprising:

a second elastic component, connected between the block and the first body or connected between the block and the second body, wherein the second elastic component always drives the block to move toward the second body or the first body to press against the third blade and maintain the peeling space.

15. The crimping hand tool according to claim 3, further comprising:

a third elastic component, connected between the first body and the second body, wherein the third elastic component constantly drives the first body to pivot to be opened relative to the second body.

* * * * *